US009927744B2

(12) United States Patent
Chueh

(10) Patent No.: US 9,927,744 B2
(45) Date of Patent: Mar. 27, 2018

(54) FIXATION MODULE WITH SEPARATION CLAW DETECTING MECHANISM AND PRINTING APPARATUS USING THE SAME

(71) Applicant: AVISION INC., Hsinchu (TW)

(72) Inventor: Chuang-Hua Chueh, Hsin Chu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 15/431,241

(22) Filed: Feb. 13, 2017

(65) Prior Publication Data

US 2017/0261896 A1 Sep. 14, 2017

(30) Foreign Application Priority Data

Mar. 9, 2016 (TW) ..... 105107139 A

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
USPC ..... 399/21, 22, 323
See application file for complete search history.

(56) References Cited

U.S. PATENT DOCUMENTS 5,608,512 A * 3/1997 Endo ..... G03G 15/2028 399/323
5,802,434 A * 9/1998 Takehara ..... G03G 15/2028 399/323
6,615,017 B2 * 9/2003 Tanaka ..... G03G 15/2028 399/323
8,186,824 B2 5/2012 Fujita
8,285,182 B2 * 10/2012 Aratachi ..... G03G 15/2028 399/323
2004/0178573 A1 * 9/2004 Hasegawa ..... B65H 29/54 271/307
2007/0036587 A1 2/2007 Yang
2013/0195477 A1 * 8/2013 Seshita ..... G03G 15/205 399/322

FOREIGN PATENT DOCUMENTS

JP 63153569 A * 6/1988
JP 06089067 A * 3/1994
JP 09179361 A * 7/1997 ..... B65H 7/06
JP 10074015 A * 3/1998
JP 2007140327 A * 6/2007
(Continued)

*Primary Examiner* — Susan Lee

(57) ABSTRACT

A fixation module comprises a body, a heater roller, a pressure roller, a separation claw assembly and a detector. The heater roller and the pressure roller are rotatably connected to the body. The pressure roller and the heater roller transport a medium and perform a fixation process on the medium. The separation claw assembly connected to the body exerts a pressure toward the heater roller. When the medium passes through a clearance between the heater roller and the separation claw assembly, the medium pushes the separation claw assembly away from the heater roller. The detector detects a state where the separation claw assembly is pushed away from the heater roller by the medium. A printing apparatus for transferring and fixing toners onto the medium and comprising the fixation module, a drum, a development roller and a transfer roller is also provided.

8 Claims, 6 Drawing Sheets

(56) References Cited

FOREIGN PATENT DOCUMENTS

| | | | | |
|---|---|---|---|---|
| JP | 2007333871 | A | * | 12/2007 |
| JP | 2010175686 | A | * | 8/2010 |
| KR | 20080049995 | A | * | 6/2008 |
| TW | I269947 | B | | 1/2007 |

* cited by examiner

FIXATION MODULE WITH SEPARATION CLAW DETECTING MECHANISM AND PRINTING APPARATUS USING THE SAME

This application claims priority of No. 105107139 filed in Taiwan R.O.C. on Mar. 9, 2016 under 35 USC 119, the entire content of which is hereby incorporated by reference.

BACKGROUND OF THE INVENTION

Field of the Invention

This disclosure relates to a fixation module and a printing apparatus using the same, and more particularly to a fixation module with a separation claw detecting mechanism, and a printing apparatus using the fixation module.

Description of the Related Art

A conventional image forming apparatus, such as a printer or a copier, achieves rapid printing and copying effects by way of laser scanning. The image forming apparatus performs a fixation process on toners on a sheet using a fixation module composed of a heater roller and a pressure roller to fix the toners onto the sheet. Then, a transporting mechanism transports the sheet to a discharge tray. In general, the sheet tends to jam at the fixation module and cannot be smoothly transported. A conventional solution is to dispose a sensor downstream of the fixation module. If the sheet does not pass through the sensor at the predetermined timing, or the sensor is triggered, the system judges the situation as paper jam, and stops transporting the sheet so that the user can perform the maintenance or eliminate the problem. However, such the solution encounters some problems because the image forming apparatus cannot always precisely obtain when the sheet should pass through the sensor, and cannot distinguish whether the paper jam has been eliminated. If the paper jam occurs at another place, the system still cannot precisely determine where the problem occurs.

In another solution, after the paper jam occurs downstream of the fixation module, the sheet repeatedly accumulated in the sheet passage pushes the separation claw on the fixation module, so that the mechanism of the separation claw is moved and outputs the warning signal of paper jam. In this solution, only the paper jam condition downstream of the fixation module can be detected, the paper jam occurred on the fixation module cannot be detected, and the sheet jamming must be accumulated to a predetermined extent so that the mechanism of the separation claw can be pushed. Thus, in the accumulating process, another sheet may also be transported and processed, so that the multi-paper jam condition occurs, and the sheet usage is wasted.

SUMMARY OF THE INVENTION

An object of this disclosure is to provide a fixation module with a separation claw detecting mechanism and a printing apparatus using the same, wherein a separation claw is used to provide the functions of separating the media and detecting the medium jam at the same time, so that the malfunction state of the printing apparatus can be found immediately.

To achieve the above-identified object, this disclosure provides a fixation module comprising a body, a heater roller, a pressure roller, a separation claw assembly and a detector. The heater roller is rotatably connected to the body. The pressure roller is rotatably connected to the body. The pressure roller and the heater roller transport a medium and perform a fixation process on the medium. The separation claw assembly is connected to the body, and exerts a pressure toward the heater roller. When the medium passes through a clearance between the heater roller and the separation claw assembly, the medium pushes the separation claw assembly away from the heater roller. The detector detects a state where the separation claw assembly is pushed away from the heater roller by the medium.

In addition, this disclosure also provides a printing apparatus comprising the fixation module, a drum, a development roller and a transfer roller. The development roller is in rolling contact with the drum to provide toners to the drum. The transfer roller exerts a pressure on the medium toward the drum, to transfer the toners from the drum to the medium. The fixation module is disposed downstream of the transfer roller to fix the toners onto the medium.

With the above-mentioned fixation module and printing apparatus, the paper jam phenomenon in the fixation module can be detected very precisely without the mis-judgement problem, so that the printing apparatus can find the malfunction and stop immediately, and the user can eliminate the malfunction.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

This disclosure will be apparent from the following detailed description, which proceeds with reference to the accompanying drawings.

The applicant has discovered that the place where the paper jam frequently occurs is located at the fixation module, but not the discharge roller disposed downstream of the fixation module.

In the embodiment of this disclosure, a separation claw separates a sheet from a heater roller to provide a separating function. When the separating function fails, the sheet is wound into a gap between the separation claw and the heater roller to push the separation claw, which pushes a link, so that a relative movement between the link and a detector is caused, and the function of real-time detecting the paper jam can be provided.

Figure 1:
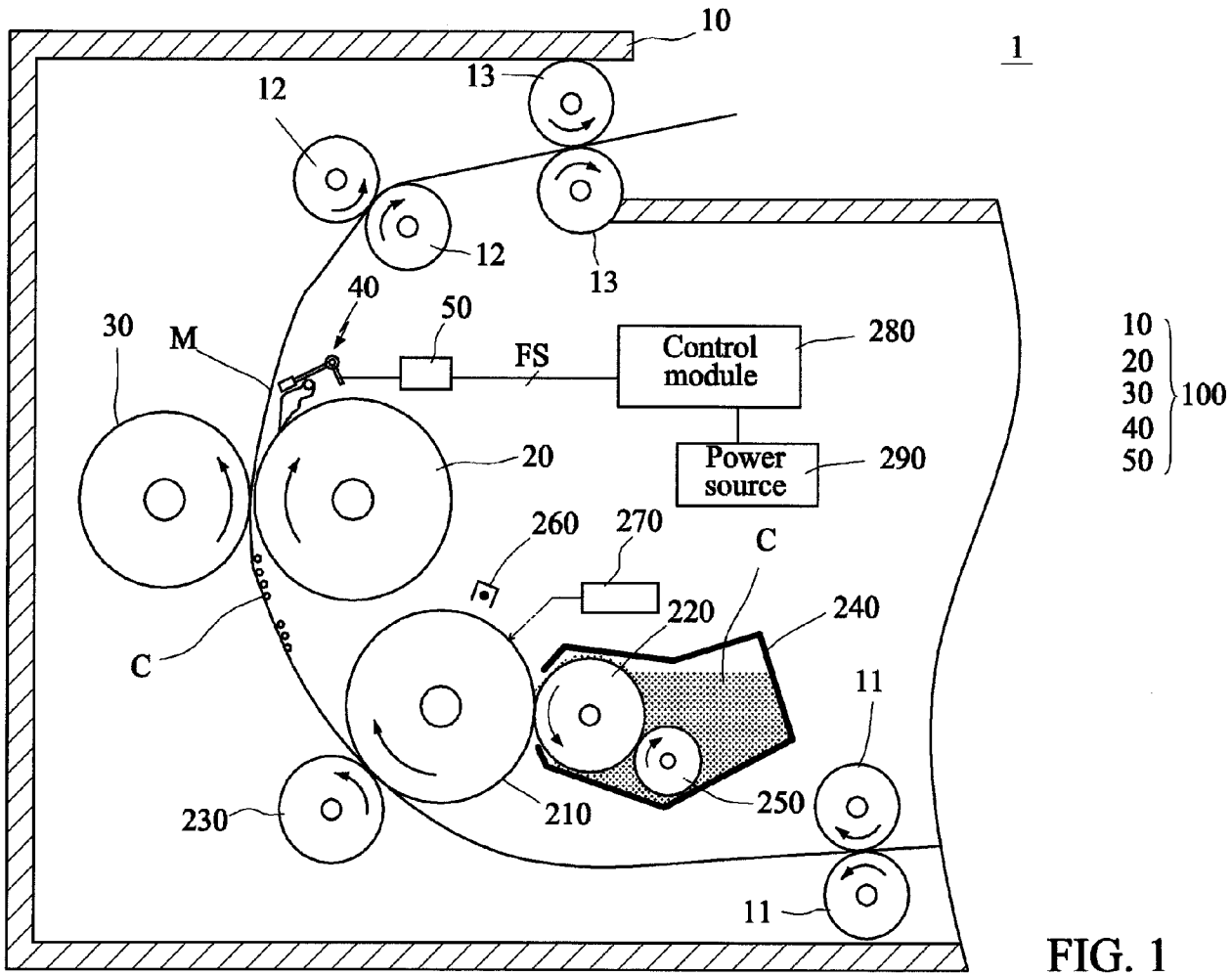
FIG. 1 is a partial schematic view showing a printing apparatus according to a preferred embodiment of this disclosure.

FIG. 1 is a partial schematic view showing a printing apparatus 1 according to a preferred embodiment of this disclosure. As shown in FIG. 1, the printing apparatus 1 of this embodiment comprises a fixation module 100, a drum 210, a development roller 220 and a transfer roller 230, all of which are disposed in a body 10. A portion of the body 10 may also be regarded as one portion of the fixation module 100. The development roller 220 is in rolling contact with the drum 210 to provide toners C to the drum 210. The transfer roller 230 exerts a pressure on a medium M toward the drum 210 to transfer the toners C from the drum 210 to the medium M. The fixation module 100 is disposed downstream of the transfer roller 230, and fixes the toners C onto the medium M. The medium M may be a sheet, a slide, or the like. The printing apparatus 1 may be a printer, such as a laser printer, or a multi-function peripheral with a laser printer.

The fixation module 100 comprises the body 10, a heater roller 20, a pressure roller 30, a separation claw assembly 40 and a detector 50.

The heater roller 20 is rotatably connected to the body 10. The pressure roller 30 is rotatably connected to the body 10. The pressure roller 30 and the heater roller 20 transport the medium M and perform a fixation process on the medium M. The separation claw assembly 40 is connected to the body 10, and exerts a pressure toward the heater roller 20. In this embodiment, the separation claw assembly 40 is pivotally connected to the body 10. In another embodiment, the separation claw assembly 40 may slide relatively to the body 10. In a first mode (normal mode), the separation claw assembly 40 separates the medium M from the heater roller 20, and the medium M does not push the separation claw assembly 40 away from the heater roller 20. In a second mode (abnormal mode), the separation claw assembly 40 makes the medium M pass through the clearance between the heater roller 20 and the separation claw assembly 40, so that the medium M pushes the separation claw assembly 40 away from the heater roller 20.

The detector 50 detects the state where the medium M pushes the separation claw assembly 40 away from the heater roller 20, and outputs a state signal FS. In this embodiment, the state signal FS is a malfunction signal for stopping the heater roller 20 or the pressure roller 30. In another embodiment, the state signal FS enables other operations, such as enabling a speaker to generate a warning sound, enabling an indicator to generate an indication signal, or the like.

In addition, the printing apparatus 1 further comprises transporting rollers 11, 12 and 13, a toner cartridge 240, a supply roller 250, a charger 260, a laser scanning unit 270, a control module (or controller) 280 and a power source 290. The toners C are accommodated within the toner cartridge 240. The supply roller 250 rotatably disposed in the toner cartridge 240 supplies the toners C to the rotatable development roller 220. The charger 260 uniformly charges the rotatable drum 210. The laser scanning unit 270 outputs laser light to form an electrostatic pattern on the drum 210. The transfer roller 230 and the drum 210 are rotatably disposed upstream of the heater roller 20, and nip the medium M, transported from the transporting roller 11, therebetween to transfer the electrostatic pattern from the drum 210 to the medium M. Next, the medium M is processed by the fixation module 100 so that the toners C are fixed onto the medium M. Then, in the first mode, the separation claw assembly 40 separates the medium M from the heater roller 20, so that the medium M is finally transported out of the printing apparatus 1 by the transporting rollers 12 and 13. In the second mode, the state signal FS also enables the control module 280 to control the power source 290 to stop the drum 210, the development roller 220, the transfer roller 230 and the transporting roller 11.

Figure 2:
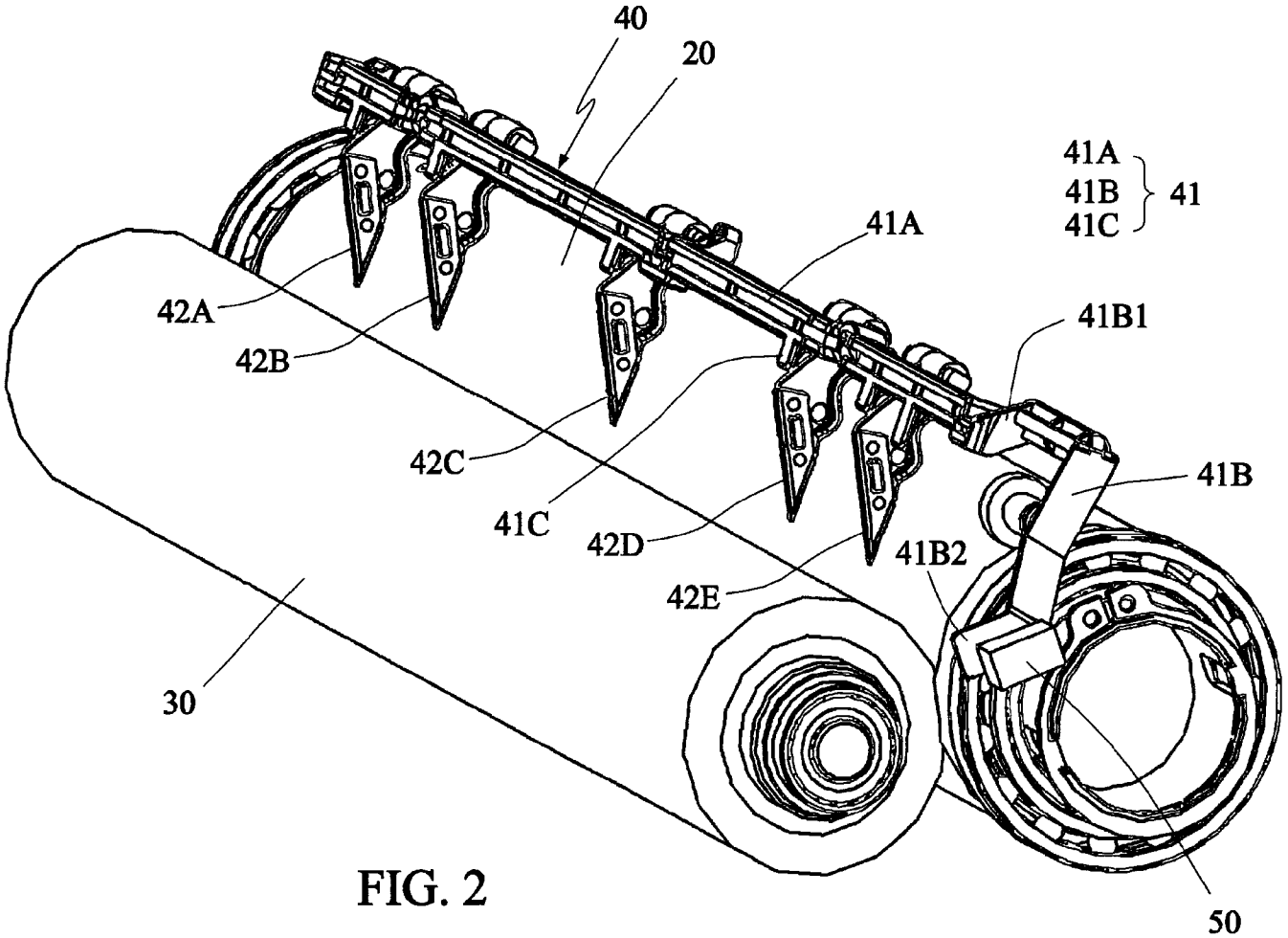
FIG. 2 is a pictorial view showing a fixation module according to the preferred embodiment of this disclosure.

FIG. 2 is a pictorial view showing a fixation module according to the preferred embodiment of this disclosure. Referring to FIG. 2, the separation claw assembly 40 comprises a link 41 and separation claws 42A to 42E. It is worth noting that only one single separation claw may also achieve the function of this embodiment. The link 41 is swingably connected to the body 10. One or multiple ones of the separation claws 42A to 42E are pushed away from the heater roller 20 by the medium M in the second mode, and push the link 41 to rotate. The detector 50 detects the rotation of the link 41 and generates the state signal FS.

Figure 3:
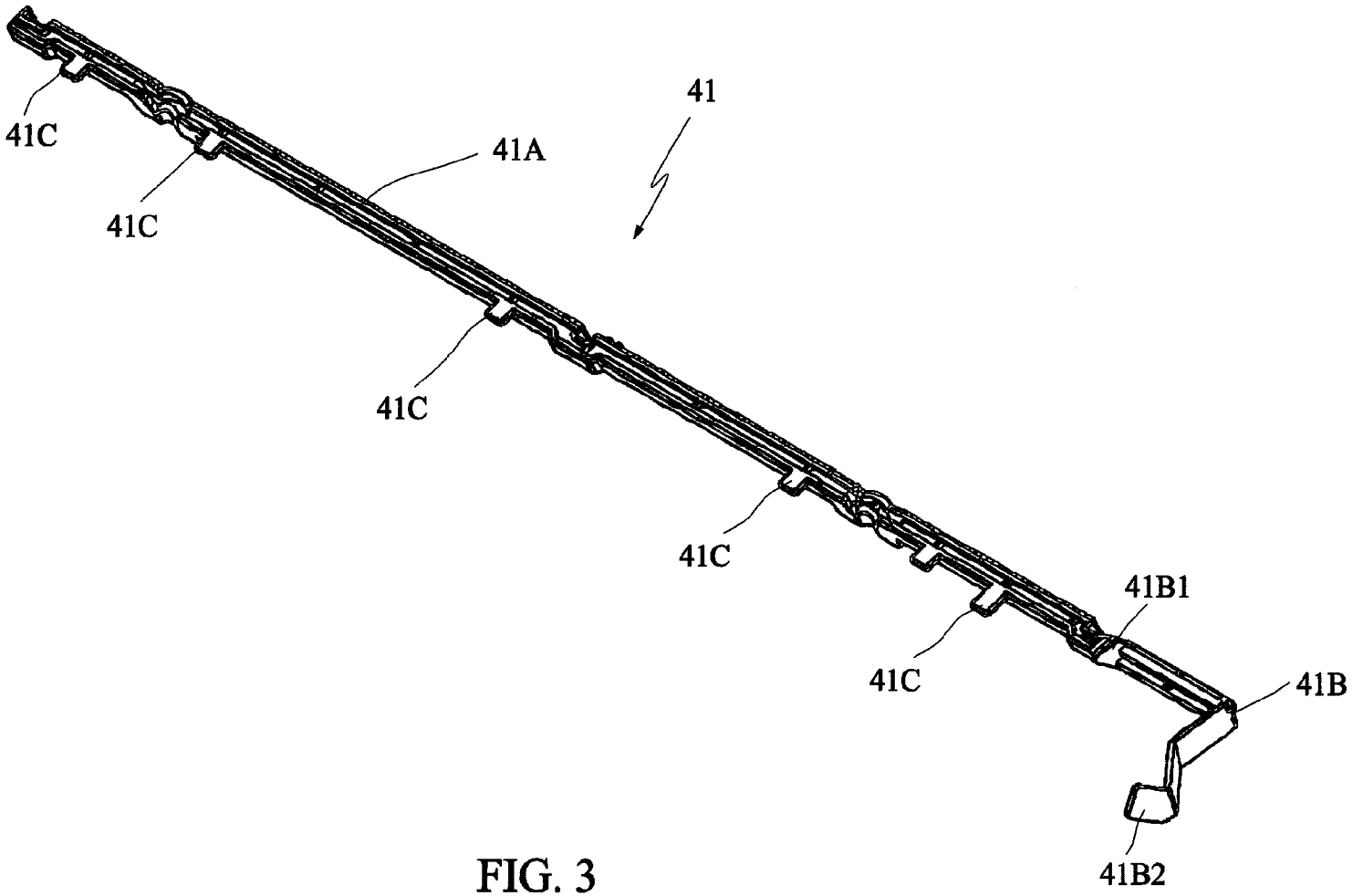
FIG. 3 is a pictorial view showing a link of FIG. 2.

FIG. 3 is a pictorial view showing the link 41 of FIG. 2. Referring to FIGS. 3 and 2, the link 41 comprises a rod 41A, a force receiving arm 41C and an output arm 41B. The rod 41A is rotatably disposed in the body 10, for example. In this embodiment, five force receiving arms 41C need to be provided to work in conjunction with the five separation claws. The force receiving arms 41C are connected to the rod 41A, and are driven by the separation claws 42A to 42E, respectively. The output arm 41B has a first end 41B1 connected to the rod 41A and a second end 41B2 opposite to the first end 41B1. The detector 50 detects the displacement (movement) of the second end 41B2 and generates the state signal FS.

Figure 4:
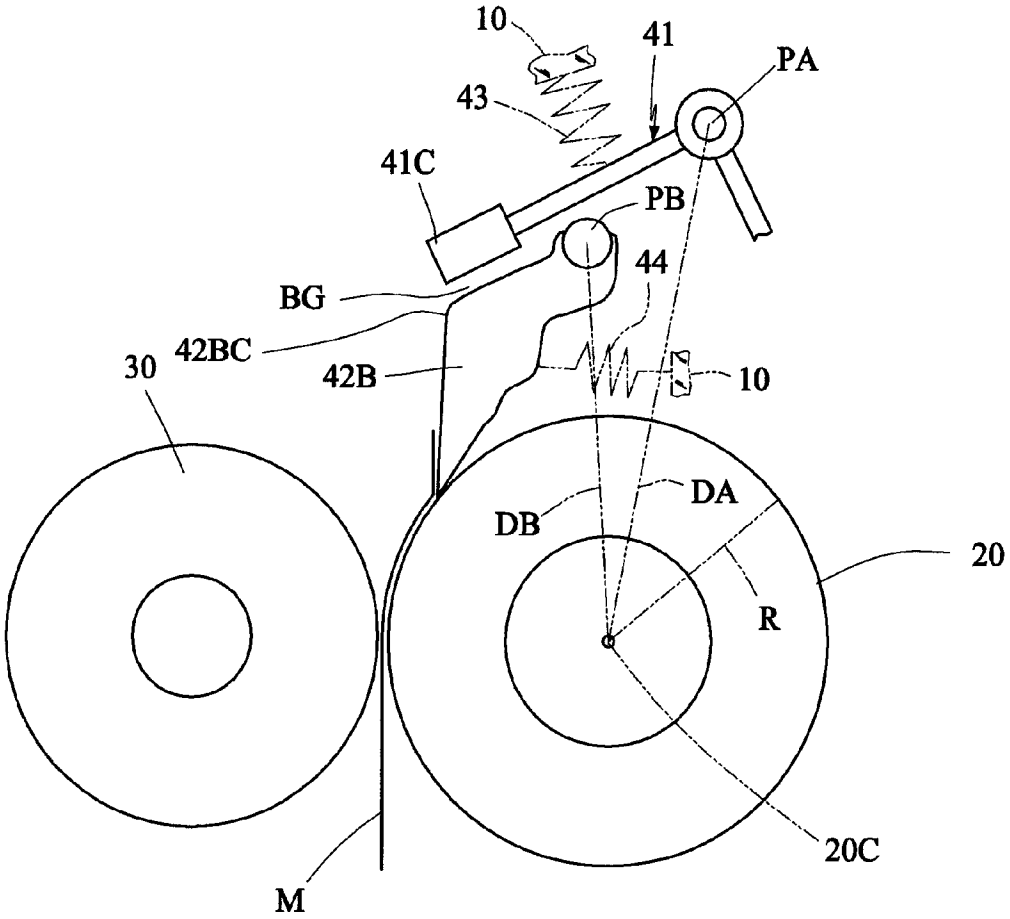
FIG. 4 is a side view showing a first mode of the fixation module of FIG. 2.
Figure 5:
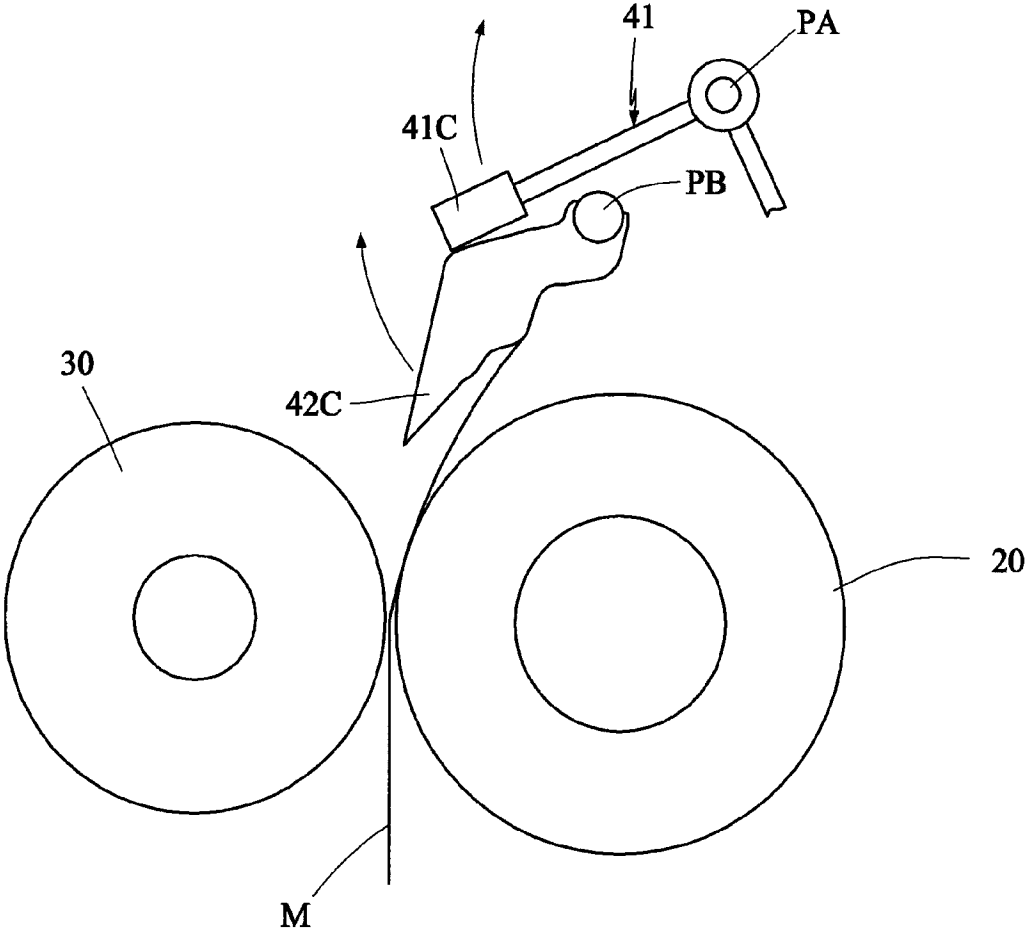
FIG. 5 is a side view showing a second mode of the fixation module of FIG. 2.

FIG. 4 is a side view showing the first mode of the fixation module of FIG. 2. FIG. 5 is a side view showing the second mode of the fixation module of FIG. 2. It is worth noting that the state signal FS is generated when the separation operation of the separation claw fails. Thus, the following condition may present, wherein one or multiple ones of the separation claws 42A to 42E are in the second mode (the separation claw 42C depicted in FIG. 5), and the other ones of the separation claws 42A to 42E are in the first mode (the separation claw 42B depicted in FIG. 4). The separation claw 42B of FIG. 4 is closer to the heater roller 20 and further from the pressure roller 30, and is disposed radially outside the heater roller 20 and the pressure roller 30. That is, the distance DA or DB from the center point 20C of the heater roller 20 to the fulcrum of the separation claw assembly 40 (the center point of the pivot PA) or to the fulcrum of the separation claw 42B (the center point of the pivot PB) is greater than the radius R of the heater roller 20, and the arced portion (arced profile) 42BC of the separation claw 42B is concave toward the heater roller 20 to separate the medium M wound around the heater roller 20. At this time, the medium M pushes the separation claw 42C in the second mode, and thus pushes the link 41 to rotate. In FIG. 5, the separation claw 42C is rotated about the pivot PB in a clockwise direction, so that the link 41 is also rotated about the pivot PA in the clockwise direction. Thus, the second end 41B2 of the output arm 41B of FIG. 2 is moved away from the detector 50, and the detector 50 generates the state signal FS.

As shown in FIG. 4, in order to prevent the minor disturbance of the separation claw from affecting the error of the state signal FS, a buffer gap BG is present between the separation claws 42A to 42E and the link 41 in the first mode. In addition, the separation claw assembly 40 further comprises a first spring 43 and one or multiple second springs 44. The first spring 43 connects the link 41 to the body 10, and provides a first resilient force to make the link 41 return to an initial position. The second springs 44 connect the body 10 to the separation claws 42A to 42E, respectively, and provide second resilient forces to make the separation claws 42A to 42E exert a pressure toward the heater roller 20. As shown in FIGS. 2 to 5, the second end 41B2 or force receiving arm 41C of the separation claw assembly 40 moves together with the movement of one of the separation claws 42A to 42E. When the second end 41B2 or force receiving arm 41C is moved from a first position (the force receiving arm of FIG. 4) to a second position (the force receiving arm of FIG. 5), the separation claw moves together with the movement of the second end 41B2 or force receiving arm 41C, and the detector 50 generates the state signal FS.

Figure 6:
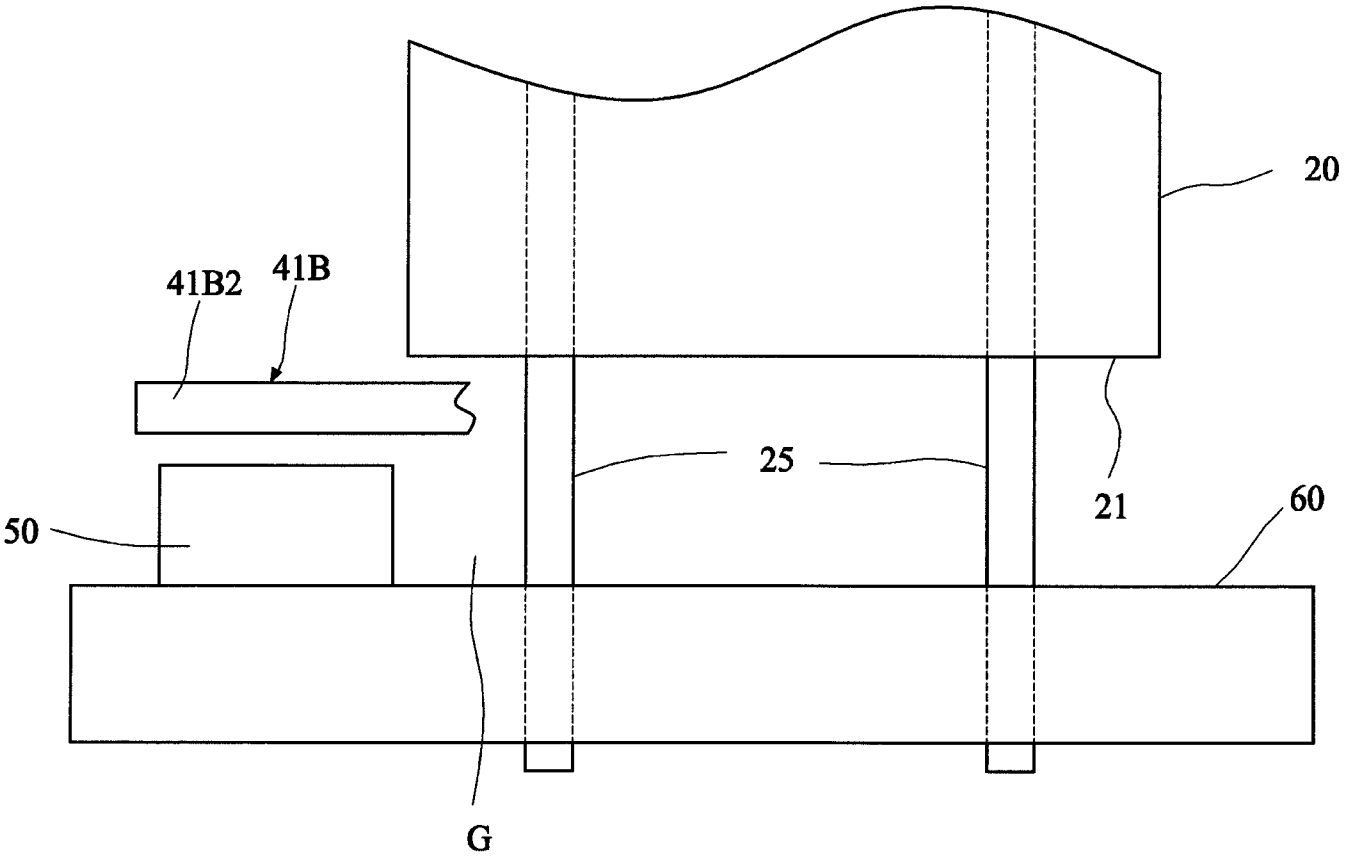
FIG. 6 is a partial top view showing the fixation module of FIG. 2.

FIG. 6 is a partial top view showing the fixation module of FIG. 2. As shown in FIG. 6, the detector 50 is an optical detector 50 for performing optical signal emitting and receiving operations on the second end 41B2 of the output arm 41B. In this embodiment, the optical detector 50 emits an optical signal, which is reflected back to the optical detector 50 by the second end 41B2 of the output arm 41B. The optical detector 50 detects this optical signal, judges that the second end 41B2 of the output arm 41B does not move, and does not output the state signal FS. On the contrary, the second end 41B2 of the output arm 41B moves out of the emitting and receiving range of the optical detector 50, and the optical detector 50 cannot receive the optical signal, and judges that the second end 41B2 of the output arm 41B moves and outputs the state signal FS.

In addition, the fixation module 100 further comprises a circuit board 60, which is electrically connected to the heater roller 20 and provides a heating power to a heater 25 of the heater roller 20 to increase the temperature of the heater roller 20 to the working temperature. The detector 50 is connected to the circuit board 60 or disposed on the circuit board 60. Thus, one portion of the output arm 41B is movable in a gap G between the detector 50 and an end surface 21 of the heater roller 20. The output arm 41B is disposed in a redundant space between the circuit board 60 and the end surface 21, so that the space can be effectively utilized, and the sizes of the fixation module 100 and the printing apparatus 1 can be reduced.

With the above-mentioned fixation module and printing apparatus, the paper jam phenomenon in the fixation module can be detected very precisely without the misjudgement problem, so that the printing apparatus can find the malfunction and stop immediately, and the user can eliminate the malfunction.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. A fixation module, comprising:

a body;

a heater roller rotatably connected to the body;

a pressure roller rotatably connected to the body, wherein the pressure roller and the heater roller transport a medium and perform a fixation process on the medium;

a separation claw assembly, which is connected to the body and exerts a pressure toward the heater roller, wherein when the medium passes through a clearance between the heater roller and the separation claw assembly, the medium pushes the separation claw assembly away from the heater roller; and a detector detecting a state where the medium pushes the separation claw assembly away from the heater roller, wherein when the detector detects the state where the medium pushes the separation claw assembly away from the heater roller, the detector outputs a state signal to stop the heater roller or the pressure roller, wherein the separation claw assembly comprises:

a link swingably connected to the body; and one or multiple separation claws, wherein the separation claw or one or multiple ones of the separation claws are pushed away from the heater roller by the medium, and push the link to rotate, and the detector detects rotation of the link and generates the state signal, and wherein the link comprises:

a rod rotatably disposed;

a force receiving arm connected to the rod and driven by the one or multiple separation claws; and an output arm having a first end connected to the rod, and a second end opposite to the first end, wherein the detector detects a displacement of the second end and generates the state signal.

2. The fixation module according to claim 1, wherein the separation claw assembly comprises the separation claws, one or multiple ones of the separation claws are pushed away from the heater roller by the medium, and the other separation claw or separation claws are not pushed away from the heater roller by the medium.

3. The fixation module according to claim 1, wherein a buffer gap is present between the separation claw and the link when the separation claw is not pushed away from the heater roller by the medium.

4. The fixation module according to claim 1, wherein the separation claw assembly further comprises:

a first spring connecting the link to the body and providing a first resilient force to make the link return to an initial position; and one or multiple second springs connecting the body to the one or multiple separation claws, and providing one or multiple second resilient forces to make the one or multiple separation claws exert the pressure toward the heater roller.

5. The fixation module according to claim 1, wherein the detector is an optical detector performing optical signal emitting and receiving operations on the second end of the output arm.

6. The fixation module according to claim 1, further comprising a circuit board, which is electrically connected to the heater roller and provides a heating power to the heater roller, wherein the detector is disposed on the circuit board.

7. The fixation module according to claim 6, wherein one portion of the output arm is movable in a gap between the detector and an end surface of the heater roller.

8. A printing apparatus, comprising:

the fixation module according to claim 1;

a drum;

a development roller, which is in rolling contact with the drum and provides toners to the drum; and a transfer roller exerting a pressure on the medium and toward the drum to transfer the toners from the drum to the medium, wherein the fixation module is disposed downstream of the transfer roller and fixes the toners onto the medium.

* * * * *